United States Patent [19]

Frank

[11] 4,382,335

[45] May 10, 1983

[54] HEAD ASSEMBLY FOR MULTIPOSITION BOREHOLE EXTENSOMETER

[75] Inventor: Donald N. Frank, Livermore, Calif.

[73] Assignee: The United States of America as represented by the United States Department of Energy, Washington, D.C.

[21] Appl. No.: 271,752

[22] Filed: Jun. 9, 1981

[51] Int. Cl.[3] ..... G01B 5/02

[52] U.S. Cl. ..... 33/125 B; 33/1 H; 33/134 R

[58] Field of Search ..... 33/1 H, 125 B, 129, 33/134 R, 141 R, 141 E, 141 G, 141.5, 147 D; 73/151, 784

[56] References Cited

U.S. PATENT DOCUMENTS

| | | | |
|---|---|---|---|
| 3,327,396 | 6/1967 | Waddell | 33/125 B |
| 3,380,167 | 4/1968 | Abel, Jr. et al. | 33/125 B |
| 3,483,745 | 12/1969 | Ublacker | 73/151 |
| 3,538,608 | 11/1970 | Bronson | 33/1 H |
| 3,562,916 | 2/1971 | Duckworth | 33/125 B |
| 3,568,326 | 3/1971 | Dodds | 33/1 H |
| 3,885,423 | 5/1975 | Schuermann et al. | 33/125 B |
| 4,001,942 | 1/1977 | Schuermann et al. | 33/125 B |

FOREIGN PATENT DOCUMENTS

| | | | |
|---|---|---|---|
| 494896 | 8/1954 | Italy | 33/134 R |
| 185501 | 9/1966 | U.S.S.R. | 33/1 H |
| 253420 | 2/1970 | U.S.S.R. | 33/125 B |
| 723128 | 3/1980 | U.S.S.R. | 33/125 B |

*Primary Examiner*—Richard R. Stearns

*Attorney, Agent, or Firm*—Henry Sartario; L. E. Carnahan; Richard G. Besha

[57] ABSTRACT

A head assembly for a borehole extensometer and an improved extensometer for measuring subsurface subsidence. A plurality of inflatable anchors provide discrete measurement points. A metering rod is fixed to each of the anchors which are displaced when subsidence occurs, thereby translating the attached rod. The head assembly includes a sprocket wheel rotatably mounted on a standpipe and engaged by a chain which is connected at one end to the metering rod and at the other end to a counterweight. A second sprocket wheel connected to the standpipe also engages the chain and drives a connected potentiometer. The head assembly converts the linear displacement of the metering rod to the rotary motion of the second sprocket wheel, which is measured by the potentiometer, producing a continuous electrical output.

7 Claims, 2 Drawing Figures

HEAD ASSEMBLY FOR MULTIPOSITION BOREHOLE EXTENSOMETER

BACKGROUND OF THE INVENTION

The United States Government has rights in this invention pursuant to Contract W-7405-ENG-48 between the U.S. Department of Energy and the University of California Lawrence Livermore National Laboratory.

The invention relates to displacement measurement of earth formations and more particularly to borehole extensometers for measuring ground subsidence.

In-situ processing of underground deposits, e.g., underground coal gasification or in-situ oil shale retorting, will allow the recovery of important energy resources in the future to partly offset the loss of conventional supplies. Large volumes of material will be processed underground; the processing region will typically have dimensions up to several hundred feet. A serious environmental drawback associated with in-situ processing is ground subsidence.

Borehole extensometers are instruments placed directly in a borehole in an earth formation to measure displacements in the earth formation. A requirement for a borehole extensometer useful for field tests of in-situ processes is the capability to measure large scale subsidence, i.e., at least several meters. The extensometer should also be of simple, yet rugged design and provide a continuous output, preferably an electrical signal.

U.S. Pat. No. 3,562,916, issued Feb. 16, 1971 to Duckworth shows a retrievable borehole extensometer wherein a linear variable differential transformer is used to detect translation of a metering rod and associated anchor.

U.S. Pat. No. 3,483,745, issued Dec. 16, 1969 to Ublacker shows a wire type extensometer having a tensioned wire and attached spring for measuring displacements.

U.S. Pat. No. 4,001,942, issued Jan. 11, 1977 to Schuermann et al discloses a rod type extensometer and U.S. Pat. No. 3,885,423 issued May 27, 1975 to Schuermann et al discloses a method of measuring changes in an area surrounding a mining cavity using extensometers.

It is an object of the invention to provide an improved borehole extensometer for measuring large-scale ground subsidence.

It is another object of the invention to provide an extensometer of simple but rugged design for field test operation.

It is also an object of the invention to provide an extensometer having continuous electrical signal output.

SUMMARY OF THE INVENTION

The invention is a head assembly for a multiposition borehole extensometer and an improved multiposition borehole extensometer including the head assembly for measuring subsurface subsidence. The extensometer comprises a conduit held in place by a plurality of inflatable anchors which provide discrete measurement points. A metering rod is fixed to each of the anchors which move with the earth, thereby displacing the rod. The head assembly converts the linear displacement of the metering rod to rotary motion which is measured with an electrical potentiometer. The head assembly includes a sprocket wheel engaged by a chain which is connected at one end to the metering rod and at the other end to a counter weight. A second sprocket wheel which drives a potentiometer also engages the chain to provide an electrical output which is proportional to the displacement of the metering rod.

DETAILED DESCRIPTION OF THE PREFERRED EMBODIMENT

Figure 1:
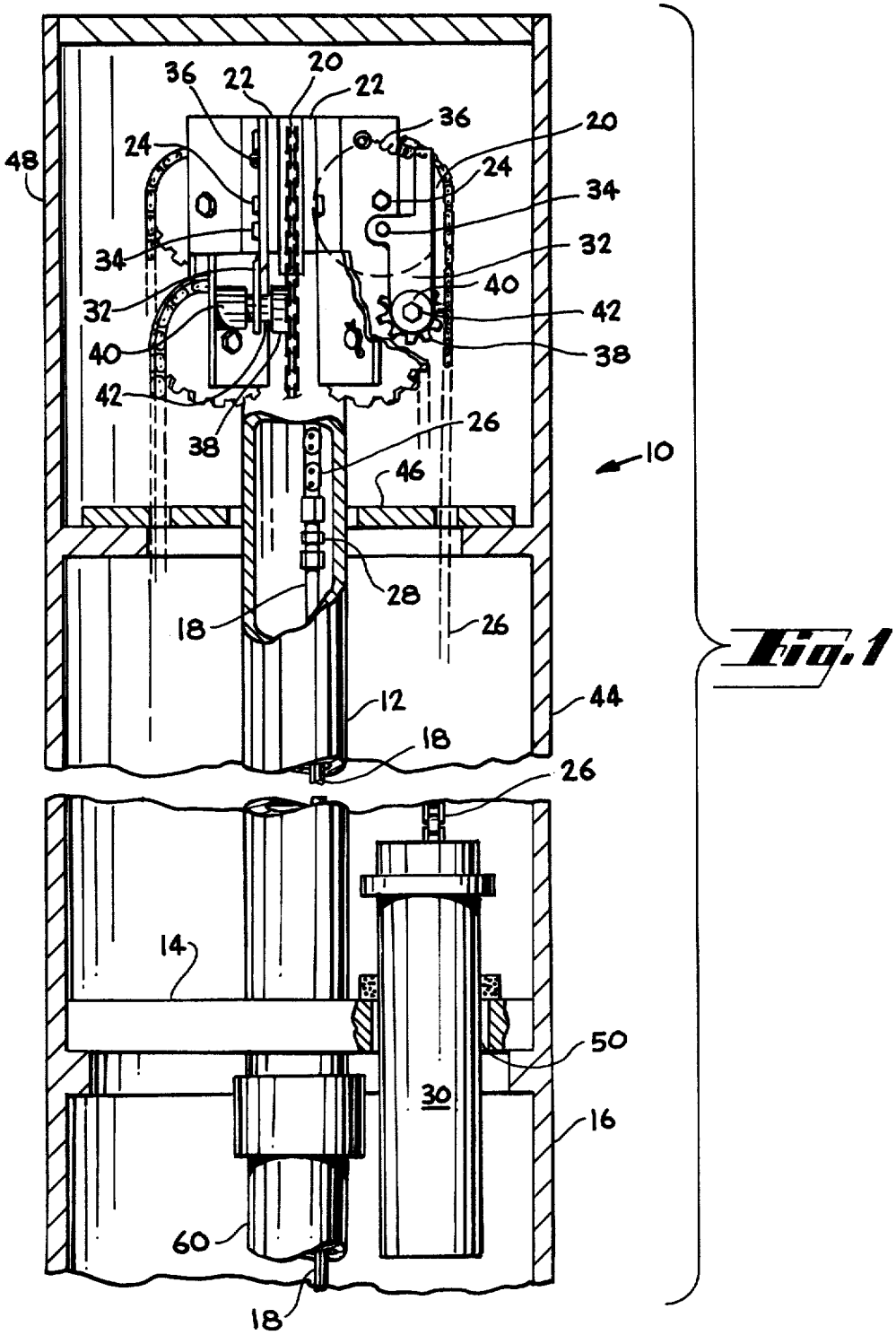
FIG. 1 is a side view, partly in section, of the multiposition, borehole extensometer head assembly.

The head assembly 10, according to the invention, as shown in FIG. 1, comprises a substantially vertical hollow standpipe 12 mounted to and extending through a plate 14 at the top of the borehole extensometer casing 16. A metering rod 18 extends vertically along the axis into hollow standpipe 12. Sprocket wheel 20 is rotatably mounted on bearing pin 24 mounted between a pair of spaced parallel flanges 22 at the top of standpipe 12. A chain 26 engages and passes over the sprocket wheel 20. One end of the chain is connected to metering rod 18 through connector 28. The other end of the chain 26 is connected to counter weight 30 which passes through a hole 50 in plate 14. An idler arm or swing arm 32 is also pivotably mounted to one of the flanges 22 at pivot point 34 adjacent to sprocket wheel 20. A sprocket wheel 38 is mounted on one end of the swing arm 32 on a shaft 42. A tension spring connecting the opposite end of the swing arm 32 to flange 22 keeps the sprocket wheel 38 engaging the chain 26 which passes over sprocket wheel 20. The sprocket wheel 38 drives shaft 42 which drives a connected potentiometer 40.

The standpipe 12 of the head assembly is partly enclosed in housing 44 mounted above the extensometer casing 16 and plate 14. An adjusting plate 46 through which the standpipe 12 passes is mounted near the top of the standpipe 12 above housing 44 but below the sprocket wheel assembly. The adjusting plate 46 is used to adjust the standpipe 12 in a vertical position. A top 48 is placed over the head assembly above the adjusting plate 46. Electrical connections (not shown) pass through the top 48 to the potentiometer 40.

Figure 2:
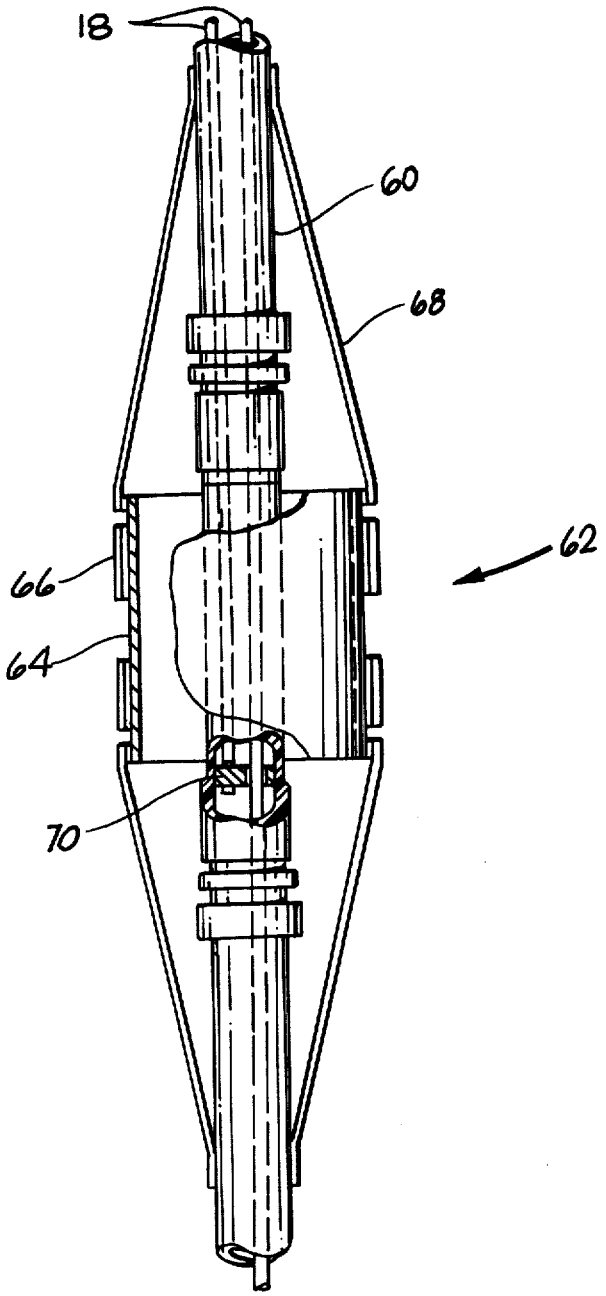
FIG. 2 is a side view, partly in section, of a segment of conduit with an anchor assembly which is connected to the multiposition, borehole extensometer head assembly.

The head assembly 10 forms a part of a borehole extensometer which is placed in and extends down a borehole shaft for measuring ground subsidence. The casing 16 of the extensometer extends down into the shaft. A conduit 60, a section of which is shown in FIG. 2, is attached to the lower end of the standpipe 12 and extends down the shaft below the casing 16 which is embedded in the borehole. At least one anchor 62 is mounted to the conduit 60. A multiposition extensometer will have a plurality of anchors. The anchor 62 comprises a sleeve 64 having inflatable bladders 66 which are inflated for holding the anchor in place in the borehole. The sleeve 64 is supported by braces 68 attached to the conduit 60. The inflatable bladders 66 are inflated through lines (not shown) which extend down through the conduit to the anchor 62. A metering rod 18 extends down through the conduit 60 to a metering rod connection plate 70 which attaches the rod 18 to the anchor 62. The other end of the metering rod 18 is connected to the chain 26.

In operation the anchor 62 is inflated and thereby held in place in the borehole. As ground subsidence occurs the anchor 62 remains fixed in the ground and is normally displaced downward. The metering rod 18 which is rigidly attached to the anchor at plate 70 is also displaced downward. The conduit is flexible and stretches. However, the metering rod 18 is rigid and the ground subsidence and movement of the anchor produces a downward displacement of the metering rod equal to the amount of ground displacement. The downward displacement of the metering rod 18 pulls the attached chain 26 over sprocket wheel 20 against counter weight 30. As the chain moves it rotates sprocket wheel 38 which engages the chain 26 through the action of swing arm 32 and tension spring 36, thereby converting the linear translation of the metering rod 18 to rotary motion of sprocket wheel 38. The sprocket wheel 38 is mounted on shaft 42 which turns potentiometer 40, thereby producing a continuous electrical output proportional to the linear displacement of the metering rod 18.

One particular extensometer embodiment incorporating the head assembly according to the invention has six anchors to provide six discrete subsidence measurement points. The conduit is 1½" in diameter, and typically is a flexible metal band wound, interlocked, PVC coated conduit. The casing 16 extends about 40 feet underground and the first anchor position is about 50 feet underground with successive anchor spacings of 30 feet, 20 feet, 12 feet, 11 feet and 8 feet, respectively. The metering rods are 3/16" aluminum rods, with one attached to each anchor 62 through a connection plate 70, the remaining rods passing through holes in the connection plate 70 to their respective associated anchors. The head assembly comprises a cluster of six separate sprocket and chain assemblies, each having a counter weight 30 and each driving a potentiometer 40 to provide six continuous independent electrical outputs. The advantage of the extensometer utilizing the head assembly according to the invention is a simple design instrument for large-scale measurements that can be utilized in field tests. The head assembly allows the support sprocket wheel 20 to carry the weight of the metering rod and counter weight which may be considerable, i.e., 100 pounds, while the measuring sprocket wheel 38 provides the output measurement without carrying the load. Each of the potentiometers in the multiposition borehole extensometer head assembly provides an electrical signal of the subsidence at a known point underground.

Changes and modifications in the specifically described embodiments can be carried out without departing from the scope of the invention, which is intended to be limited only by the scope of the appended claims.

I claim:

1. A head assembly for a borehole extensometer, comprising:

a vertical hollow standpipe;

a first sprocket wheel rotatably mounted to the standpipe;

a chain passing over and engaging the first sprocket wheel;

a member movably mounted to the standpipe;

a second sprocket wheel rotatably mounted to the member;

means connected to the standpipe and to the member for maintaining the second sprocket wheel in engagement with the chain; and a potentiometer connected to and driven by the second sprocket wheel.

2. The apparatus of claim 1, wherein the standpipe includes a pair of spaced parallel flanges extending from the top of the standpipe, the first sprocket wheel being rotatably mounted between the flanges.

3. The apparatus of claim 1 or 2, wherein the member is a swing arm pivotably mounted to the standpipe.

4. The apparatus of claim 3, wherein the means for maintaining the second sprocket wheel in engagement with the chain is a spring connecting the swing arm to the standpipe.

5. A borehole extensometer for measuring ground subsidence around a borehole in an earth formation, comprising:

a casing embedded in the borehole at the top of the borehole;

a conduit aligned with and extending down the borehole;

a radially expandable anchor mounted to the conduit and adapted to be firmly fixed at a position in the earth formation;

a metering rod aligned with and extending down the conduit in the borehole, the metering rod being connected at its lower end to the anchor;

a vertical hollow standpipe mounted to the casing and connected to the conduit;

a first sprocket wheel rotatably mounted to the standpipe;

a chain passing over and engaging the first sprocket wheel, the chain being connected at one end to the top of the metering rod;

a counterweight attached to the opposite end of the chain;

a member movably mounted to the standpipe;

a second sprocket wheel rotatably mounted to the member;

means connected to the standpipe and the member for maintaining the second sprocket wheel in engagement with the chain; and a potentiometer connected to and driven by the second sprocket wheel.

6. The extensometer of claim 5, wherein the member is a swing arm pivotably mounted to the standpipe.

7. The extensometer of claim 6 wherein the means for maintaining the second sprocket wheel in engagement with the chain is a spring connecting the swing arm to the standpipe.

* * * * *